United States Patent [19]

Blish

[11] Patent Number: 5,016,583

[45] Date of Patent: May 21, 1991

[54] VARIABLE INTAKE AND EXHAUST ENGINE

[76] Inventor: Nelson A. Blish, 302 Cove Creek La., Houston, Tex. 77042

[21] Appl. No.: 360,320

[22] Filed: Jun. 2, 1989

Related U.S. Application Data

[60] Division of Ser. No. 144,549, Jan. 13, 1988, Pat. No. 4,964,984, which is a continuation-in-part of Ser. No. 902,633, Sep. 2, 1986, abandoned.

[51] Int. Cl.[5] ..... F01L 7/00

[52] U.S. Cl. ..... 123/190 BC; 123/323; 123/90.11

[58] Field of Search ..... 123/323, 190 BC, 190 A, 123/65 B, 73 B, 90.11

[56] References Cited

U.S. PATENT DOCUMENTS

| | | | |
|---|---|---|---|
| 1,095,565 | 5/1914 | Ferres | 123/190 BC |
| 4,557,233 | 12/1985 | Joppig et al. | 123/323 |
| 4,793,347 | 12/1988 | Taniuchi et al. | 123/323 |
| 4,823,825 | 4/1990 | Büchl | 123/90.11 |
| 4,920,931 | 1/1990 | Klomp | 123/323 |

*Primary Examiner*—E. Rollins Cross

[57] ABSTRACT

An internal combustion engine (10) incorporating a rotary intake-exhaust valve (30). Intake exhaust valve (30) rotates between intake passage (36) and exhaust passage (34) such that intake-exhaust port (28) is aligned with intake passage (34) during the intake cycle and aligned with exhaust passage (34) during the exhaust cycle. Use of a rotary valve eliminates vibration normally found when reciprocating intake valve and exhaust valve are used and also provides weight saving due to simplified manufacturing processes, fewer parts and a higher strength engine wall due to elimination of one opening port into the engine. Valve (30) is operated by electromechanically means (40) so that the point in the power cycle at which air is admitted and exhausted may be varied. Means (40) may also be used to vary the length of time the exhaust port or intake port is open.

6 Claims, 4 Drawing Sheets

VARIABLE INTAKE AND EXHAUST ENGINE

BACKGROUND OF THE INVENTION

This application is a division of U.S. Ser. No. 07/144,549 filed Jan. 13, 1988, now U.S. Pat. No. 4,964,984 which is continuation-in-part of U.S. Ser. No. 902,633 filed Sept. 2, 1986 now abandoned.

1. Field of the Invention

This invention relates to internal combustion engines and more particularly, to an improved rotary valve for intake of air-gas mixtures and exhaust of combustion products.

2. Background

The internal combustion engine has become the workhorse of modern society and is found in all parts of the world. Despite continual improvement over the years in the design and the operation of the engine, there are some parts which have remained essentially the same since the first engines were built.

Two of these parts are the intake valve which is used to admit fresh air and gas for combustion, and the exhaust valve which exhausts the combustion products. While these valves have undergone some technical improvements such as hardening of the valve surface to reduce wear, they have changed little and are still associated with many problems in the operation of the internal combustion engine.

The problems associated with intake and exhaust valves are mainly due to the reciprocating motion of the valves. Once during each cycle the intake valve moves into the cylinder and returns, impacting against the valve seat with some force. The exhaust valve operates in a similar manner. Thus during each complete cycle of intake, compression, power and exhaust, these two valves cycle inward and then outward impacting the valve seats. These repeated impacts cause wear on the valve seats and the valves and cause vibration of the engine. Since many automobile engines have four, six or eight cylinders and operate at high rates of speed, these repeated impacts and vibrations cause much additional noise and, the additional vibrations cause stress cracks and wear out the valves and other parts more rapidly.

An additional problem is that these valves, the intake valve and the exhaust valve, are two additional parts that must be added to engines, not to mention their associated synchronizing parts. In modern manufacturing, reduction in the number of parts necessary to manufacture a product leads directly to a reduction in material costs, reduced weight of the product, which in turn means increased efficiency and miles per gallon.

Prior attempts to solve problems associated with intake and exhaust valves have suffered from various drawbacks. For example, Ferres, U.S. Pat. No. 1,095,565, describes a conical shaped rotary exhaust valve. However, the conical shaped exhaust valve shown in Ferres is as massive as some of the engine cylinders and would add weight to the engine rather than reducing weight. Other examples of rotary valves shown in the prior art suffer from similar limitations. For example, Johnson, U.S. Pat. No. No. 1,515,052 shows a spool shaped rotary valve; Francis, U.S. Pat. No. 1,340,481 shows a tapered conical valve body; Whitten, U.S. Pat. No. 1,528,715 shows a cylindrical rotary valve; Russell, U.S. Pat. No. 1,284,463 shows a cylindrical rotary axially tapered rotary valve; Mettson, U.S. Pat. No. 1,271,344 shows a cylindrical valve; Keller, et al., U.S. Pat. No. 1,513,911 shows a solid shaft valve.

A further problem with prior art internal combustion engines and with the examples of the various rotary valve engines described above is that the opening of the inlet and exhaust ports on the engine is rigidly tied to movement of the crankshaft. It is desirable to be able to adjust the opening of the intake and valve and the exhaust valve during operation of the engine to take into account various atmospheric conditions such as humidity and air pressure and to also taken into account, temperature and loading of the engine. Present construction with the opening and closing of the inlet and exhaust valves rigidly, mechanically connected to rotation of the crankshaft does not allow for advancing the point in the intake cycle at which the intake valve opens or the point in the exhaust cycle at which the exhaust port opens.

SUMMARY

The present invention is an improved internal combustion engine which uses spherical rotary intake valves and spherical rotary exhaust valves. Since each valve rotates to alternately line up an intake port with an intake manifold and an exhaust port with an exhaust manifold during the cycle of intake, compression, power and exhaust, they are not subject to repeated reciprocating motion and associated impact on the valve seats found in typical internal combustion engines. In a further embodiment of the invention, the intake and exhaust valves are operated by electromechanical means which is synchronization with the crankshaft. Since the intake and exhaust valves are not mechanically connected to the crankshaft, it is possible to alter, during operation of the engine, the timing of the admission of the air-gas mixture during the intake stroke and the timing of the opening to the exhaust manifold on the exhaust stroke to take into account factors such as internal heat of the engine and external atmospheric conditions. In yet another embodiment of the invention, the intake and exhaust port are combined and a single rotary valve functions both as an intake exhaust valve. The combined valve alternately lines up the intake-exhaust port with the intake manifold, during one part of the cycle, and with the exhaust manifold during another part of the cycle. This eliminates one additional part and further reduces the weight of the engine by reducing the weight necessary for manufacturing the cylinder with one less opening into the cylinder.

DETAILED DESCRIPTION OF THE INVENTION

Figure 1:
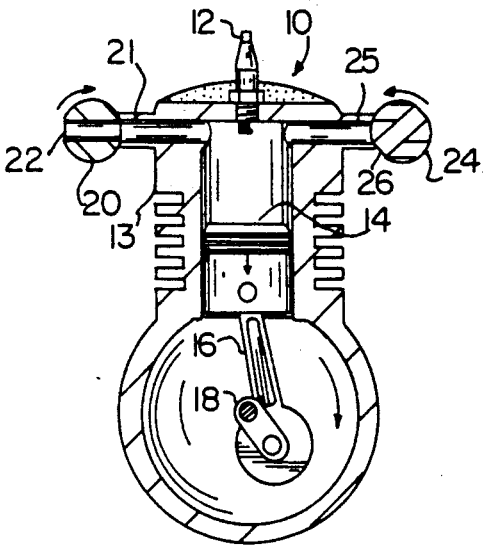
FIG. 1 is a sectional view of the intake stroke of an internal combustion engine according to the present invention.

FIG. 1 shows an internal combustion engine, specifically a gasoline engine, shown by reference numeral 10. The basic components of the engine 10 are cylinder 13, which encloses piston 14, which is connected by piston rod 16 to crank shaft 18. Engine 10 operates in a manner similar to normal combustion engines and uses spark plug 12 to ignite the gas and air mixture to provide power to drive piston 14.

The innovative feature of this engine according to the present invention reside in intake valve 20 and exhaust valve 24. These valves are rotary valves and are essentially spherical in shape with a passage way 22 along the approximate centerline of intake valve 20 and a similar passage way 26 in exhaust valve 24. The rotary inlet valve and rotary exhaust valve would each be firmly attached to the inlet and exhaust outlet by being incorporated as part of the engine block or other suitable means.

Examining the operation of these valves as shown in FIGS. 1 through 4, it is seen that intake valve 20 rotates in a clockwise manner during the engine cycle and rotates approximately 180 degrees during one complete cycle of the engine. Thus, in FIG. 1, passage way 22 of intake valve 20 is aligned with an intake manifold, not shown, such that fresh air and gasoline may be drawn into engine 10 as piston 14 moves down during the intake stroke. During the intake stroke, exhaust valve 24, which rotates in a counterclockwise manner, has passage way 26 lined up so that there is no outlet through the exhaust port to the exhaust manifold, not shown.

Figure 2:
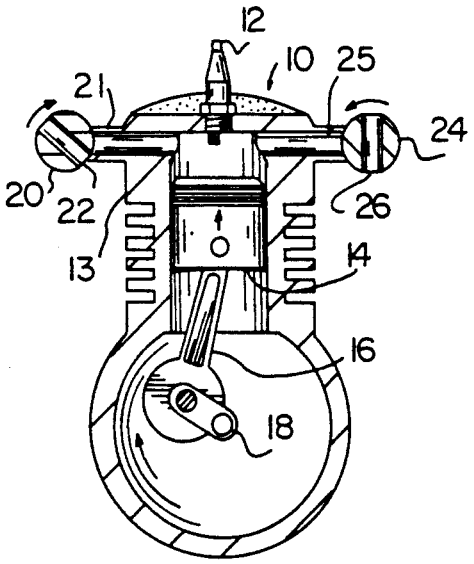
FIG. 2 is a sectional view of the engine shown in FIG. 1 on the compression stroke.

In the compression stroke, shown in FIG. 2, intake valve 20 has rotated in a clockwise manner such that intake port 2 has been sealed by intake valve 20. In a similar manner, exhaust valve 24 continues to seal exhaust port 25. Thus the gas and air mixture inside engine 10 is compressed on the compression stroke.

Figure 3:
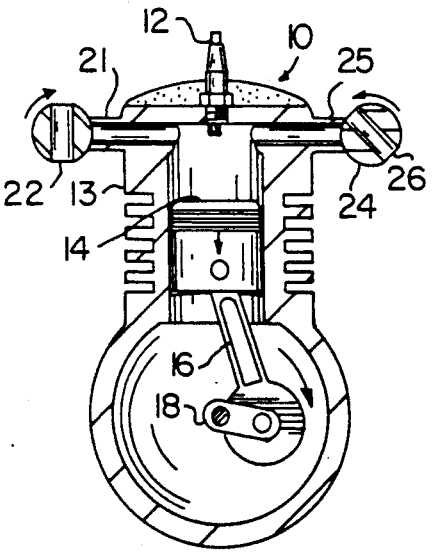
FIG. 3 is a sectional view of the engine shown in FIG. 1 on the power stroke.

In FIG. 3, the gas and air mixture has been ignited by sparkplug 12 forcing the piston 14 down during the power stroke. Intake valve 20 continues to seal intake port 21 and exhaust valve 24 continues to seal exhaust port 25.

Figure 4:
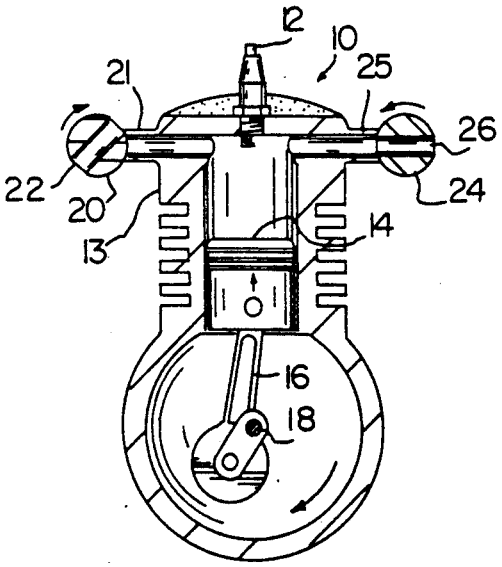
FIG. 4 is a sectional view of the engine shown in FIG. 1 on the exhaust stroke.

During the exhaust stroke, shown in FIG. 4, exhaust valve 24 has rotated counter clockwise such that passage way 26 is lined up with exhaust port 25 so that exhaust gases from combustion may be expelled through exhaust port 25, passage 26, to an exhaust manifold as piston 14 moves upward. Intake port 21 remains sealed by intake valve 20.

Figure 5:
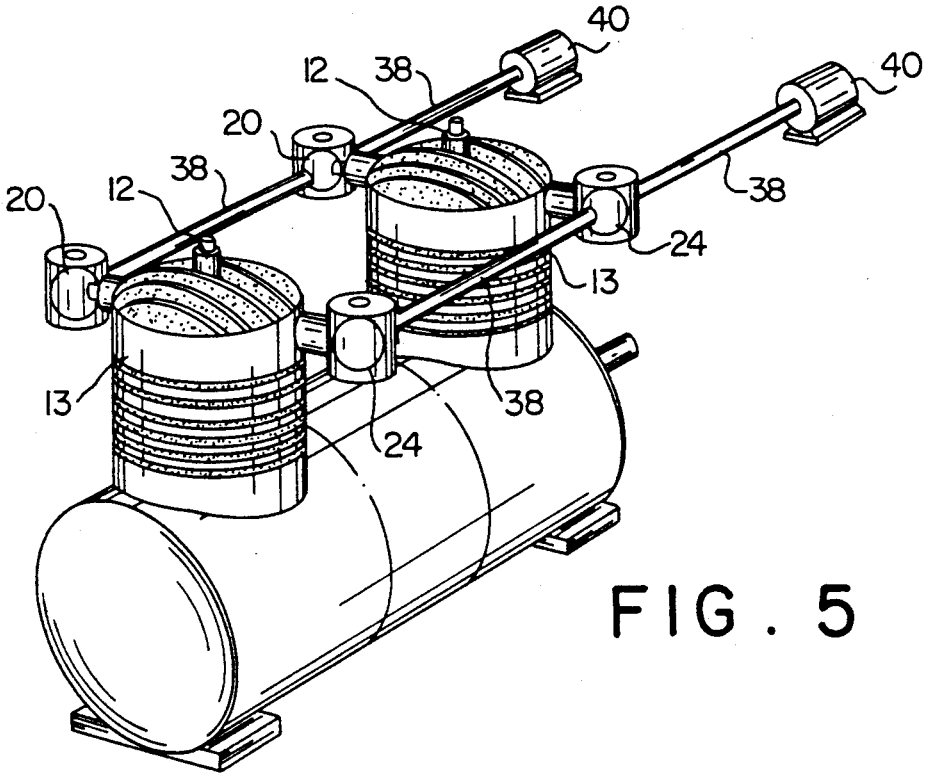
FIG. 5 is a prospective view of a two cylinder engine showing interconnection of the rotary valves and rotary exhaust valves.
Figure 5A:
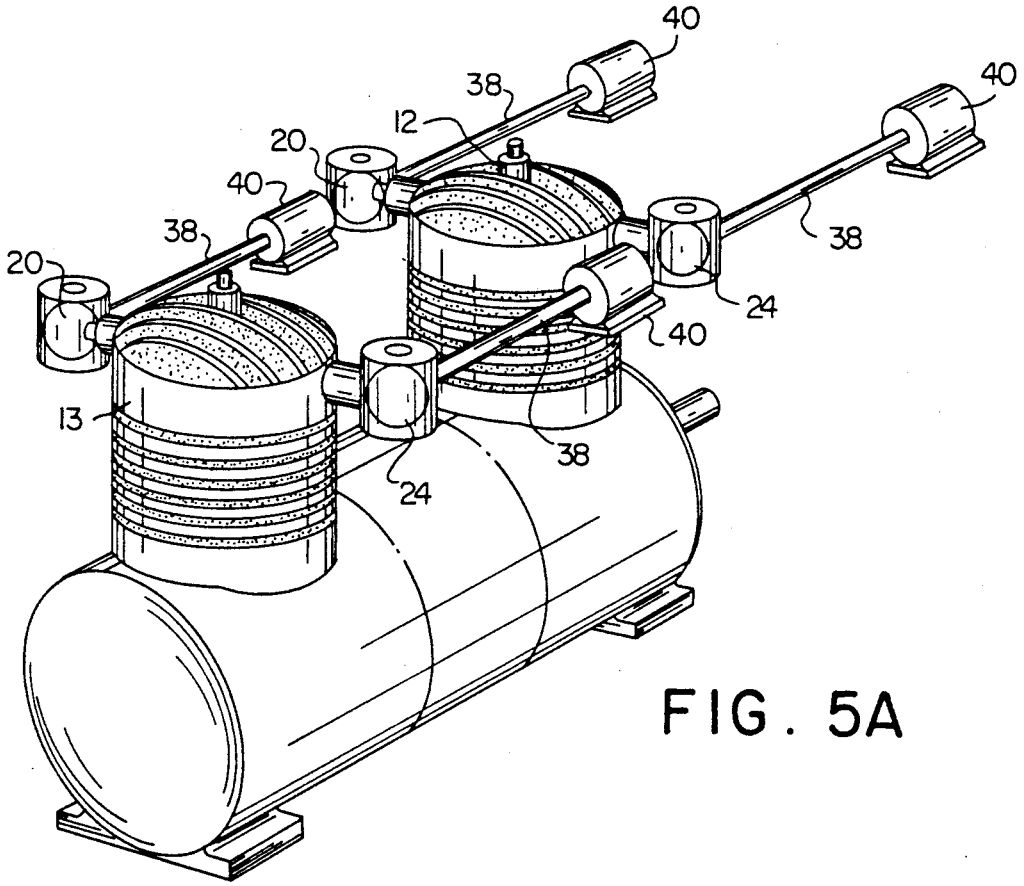
FIG. 5A is a prospective view of a two cylinder engine showing an alternate embodiment of the present invention.

FIG. 5 shows two cylinders 13 operating in tandem. The inlet valves are connecting by operating rods 38. Operating rods 38 are driven by operating means 40. In the preferred embodiment of the invention, operating means 40 electrically drive rods 38 which in turn rotate inlet and exhaust valves 20 and 24 so that the intake and exhaust ports are opened at appropriate times during the intake stroke and the exhaust stroke of the engine operation. Using an electric drive motor, the opening of the intake valve can be advanced or retarded much as the spark is advanced or retarded during different engine loading conditions. Also, sensors can be used to determine temperature, humidity, and pressure of the ambient air to advance or retard either the rotary intake valve or the rotary exhaust valve, or both. Also, the amount of time that valve is opened or closed can be varied since the valve position is controlled electronically. FIG. 5A shows an embodiment wherein the position of each individual valve is controlled by separate electrical means so that individual cylinder wear can be compensated for.

Figure 6:
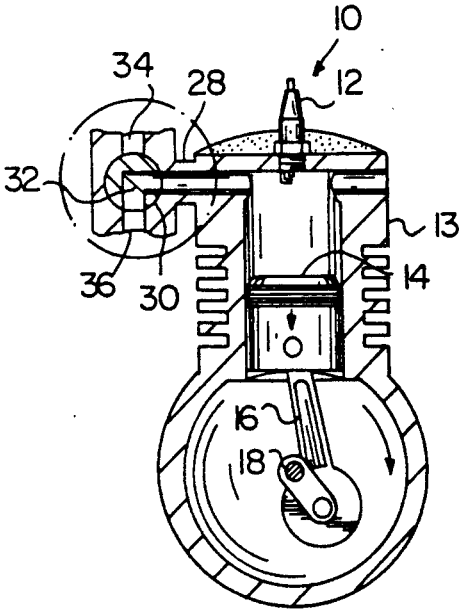
FIG. 6 is a sectional view of an internal combustion engine on the intake stroke showing yet another embodiment of the invention.

FIG. 6 shows an alternate embodiment of the invention which uses a combined intake exhaust port 28 for engine 10. Intake-exhaust valve 30 has a passage 32 with external openings at approximately right angles to each other. Exhaust passage 34 leads to an exhaust manifold, not shown, and intake passage 36 leads from intake manifold, also not shown. FIG. 6 shows the intake stroke of the engine with intake-exhaust valve 30 lined up so that passage 32 connects intake-exhaust port 28 with intake passage 26. Thus as piston 14 moves down, a gasoline and air mixture is being drawn into cylinder 13.

Figure 7:
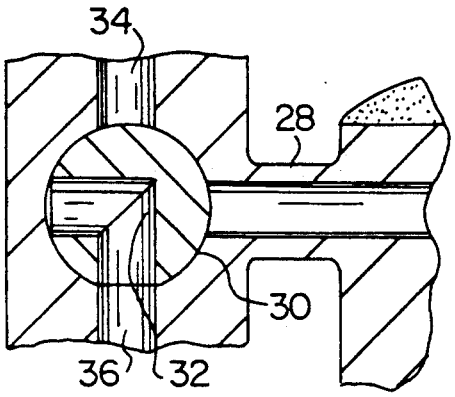
FIG. 7 is an enlarged view of a portion of the engine shown in FIG. 6 on the compression stroke.

During the compression stroke, shown in FIG. 7, intake-exhaust valve 30 rotates clockwise so that intake exhaust port 28 is closed off by valve surfaces. Thus, there is no exit from engine 10 and the gas and air mixture is compressed.

Figure 8:
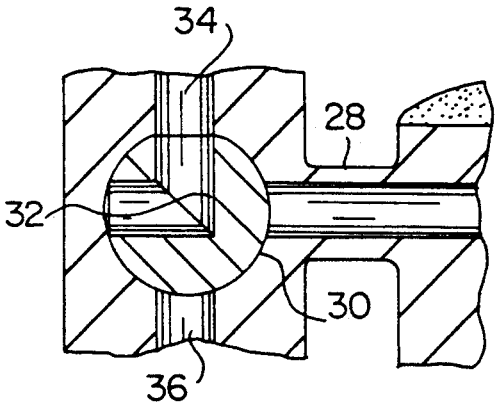
FIG. 8 is an enlarged view of a portion of the engine shown in FIG. 6 on the power stroke.

FIG. 8 illustrates the position of the intake-exhaust valve 30 during the power stroke. In this part of the cycle, valve 30 has rotated another quarter of a turn in a clockwise direction leaving intake exhaust port 28 still closed off.

Figure 9:
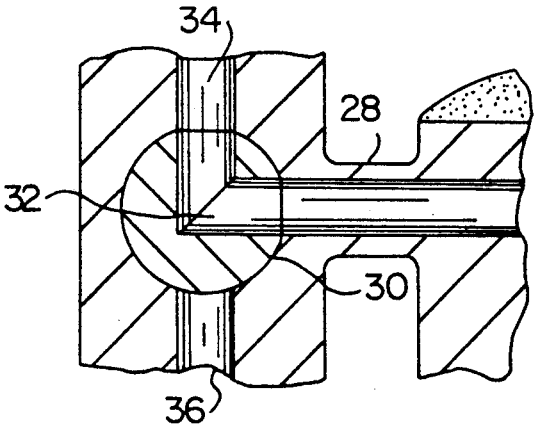
FIG. 9 is an enlarged view of a portion of the engine shown in FIG. 6 on the exhaust stroke.

In FIG. 9, valve 30 has rotated further in a clockwise direction so that passage 32 is now lined up so that exhaust gases may exit through intake-exhaust port 28 through passage 32 to exhaust passage 34.

Thus it is seen in this embodiment that there is only one opening in engine 10. Eliminating the one additional opening results in a stronger engine for the amount of materials used and may allow a further reduction in materials. As is well known, reduction in material weight leads to savings on gasoline and increased miles per gallon. Also one additional moving part has been eliminated. Each part that is eliminated simplifies the manufacturing process and decreases the time and labor expenses necessary to manufacture an engine. Also elimination of the additional moving part further reduces the overall weight of the engine.

Throughout the disclosure, a four cycle gasoline engine has been used for purposes of illustration. The present invention is also applicable to diesel engines, rotary engines and two-cycle gasoline engines and, in fact, any type of engine or internal combustion engine that has intake or exhaust ports.

Yet an additional embodiment that is practical would involve rotation of the rotary valves in other directions than are shown. For example, the intake valve and exhaust valve could both operate in a clockwise direction or they could both operate in a counter clockwise direction. It is also feasible to provide for rotary valve motion on an axis which is parallel to the axis of the piston rod.

Also, using electromechanical means to open and close the inlet and exhaust manifold independently of crankshaft movements, lends itself to other valve shapes than spherical. For example, cylindrical, cone and even conventional poppet valves may be used. Also electromechanical operating means could be used to improve the efficiency of reciprocating valves.

Thus it is seen that an engine manufactured according to the present invention, utilizes rotary valves which are significant improvements over prior art engines since the reciprocating motion of intake exhaust valves is eliminated. Also using rotary valves, there is a possibility for reduction in the overall weight of the engine, a simplified manufacturing process leading to decreased manufacturing cost and increased miles per gallon for automobiles.

Parts List

10: Engine
12: Sparkplug
13: Cylinder
14: Piston
16: Piston Rod
18: Crankshaft
20: Rotary Intake Valve
21: Intake Port
22: Intake Passage
24: Exhaust Valve
25: Exhaust Port
26: Exhaust Passage
28: Intake-Exhaust Port
30: Rotary Intake-Exhaust Valve
32: Right Angle Passage
34: Exhaust Passage
36: Intake Passage
38: Operating Rod
40: Operating Means

I claim:

1. An internal combustion engine having at least one cylinder and piston improvements therein comprising:
an exhaust valve on said cylinder;
means for opening and closing said exhaust valve capable of being advanced and retarded independently of the movement of said piston.

2. An internal combustion engine as in claim 1, a further improvement comprising:
an intake valve on said cylinder;
means for opening and closing said intake valve capable of being advanced and retarded independently of the movement of said piston.

3. An internal combustion engine as in claim 2, having more than one cylinder wherein said intake valve on each cylinder is connected by an operating rod to an intake valve on another cylinder and to said means.

4. An internal combustion engine as in claim 1, having more than one cylinder wherein said exhaust valve for each cylinder is connected by an operating rod to an exhaust valve on another cylinder and to said means.

5. An internal combustion engine as in claim 1 wherein said exhaust valve operates as both an exhaust valve and intake valve.

6. An internal combustion engine as in claim 5, having more than one cylinder wherein said exhaust valve for each cylinder is connected by an operating rod to an exhaust valve on another cylinder and to said means.

* * * * *